US009357300B2

(12) United States Patent
Su

(10) Patent No.: US 9,357,300 B2
(45) **Date of Patent: *May 31, 2016**

(54) SYSTEMS AND METHODS FOR PROTECTING A SPEAKER

(71) Applicant: Cirrus Logic, Inc., Austin, TX (US)

(72) Inventor: Jie Su, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/864,639

(22) Filed: Sep. 24, 2015

(65) Prior Publication Data

US 2016/0014507 A1 Jan. 14, 2016

Related U.S. Application Data

(63) Continuation of application No. 13/791,461, filed on Mar. 8, 2013, now Pat. No. 9,173,027.

(51) Int. Cl.
*H04R 3/00* (2006.01)

(52) U.S. Cl.
CPC ..... *H04R 3/007* (2013.01)

(58) Field of Classification Search
None
See application file for complete search history.

(56) References Cited

U.S. PATENT DOCUMENTS

| | | | |
|---|---|---|---|
| 2011/0182434 | A1 | 7/2011 | Martz et al. |
| 2011/0211705 | A1 | 9/2011 | Hutt |
| 2011/0228945 | A1 | 9/2011 | Mihelich et al. |
| 2012/0051558 | A1 | 3/2012 | Kim et al. |

*Primary Examiner* — Paul Huber
(74) *Attorney, Agent, or Firm* — Jackson Walker L.L.P.

(57) ABSTRACT

In accordance with embodiments of the present disclosure, systems and methods may include a controller configured to be coupled to an audio speaker, wherein the controller receives one or more signals indicative of one or more operating characteristics of the audio speaker and compares the one or more operating characteristics to one or more speaker protection thresholds, and based on the comparison, processes an audio input signal to generate an audio output signal communicated from the controller to the audio speaker, further wherein the one or more speaker protection thresholds are based on offline reliability testing of one or more audio speakers similar to the audio speaker and the controller generates one or more modeled parameters for the audio speaker and modifies the one or more speaker protection thresholds based on the one or more modeled parameters.

16 Claims, 4 Drawing Sheets

SYSTEMS AND METHODS FOR PROTECTING A SPEAKER

The present disclosure claims priority to U.S. patent application Ser. No. 13/791,461, filed Mar. 8, 2013, which is incorporated by reference herein in its entirety.

FIELD OF DISCLOSURE

The present disclosure relates in general to audio speakers, and more particularly, to modeling characteristics of a speaker system in order to protect audio speakers from damage.

BACKGROUND

Audio speakers or loudspeakers are ubiquitous on many devices used by individuals, including televisions, stereo systems, computers, smart phones, and many other consumer devices. Generally speaking, an audio speaker is an electroacoustic transducer that produces sound in response to an electrical audio signal input.

Given its nature as a mechanical device, an audio speaker may be subject to damage caused by operation of the speaker, including overheating and/or overexcursion, in which physical components of the speaker are displaced too far a distance from a resting position. To prevent such damage from happening, speaker systems often include control systems capable of controlling audio gain, audio bandwidth, and/or other components of an audio signal to be communicated to an audio speaker.

However, existing approaches to speaker system control have disadvantages. For example, many such approaches model speaker operation based on measured operating characteristics, but employ linear models. Such linear models may adequately model small signal behavior, but may not sufficiently model nonlinear effects to a speaker caused by larger signals. In addition, many existing approaches may only be capable of determining that an overheating event or overexcursion event has occurred after actual occurrence of such event, by which time speaker damage may have already occurred.

SUMMARY

In accordance with the teachings of the present disclosure, certain disadvantages and problems associated with protecting a speaker from damage have been reduced or eliminated.

In accordance with embodiments of the present disclosure, a system may include a controller configured to be coupled to an audio speaker, wherein the controller receives one or more signals indicative of one or more operating characteristics of the audio speaker and compares the one or more operating characteristics to one or more speaker protection thresholds, and based on the comparison, processes an audio input signal to generate an audio output signal communicated from the controller to the audio speaker, further wherein the one or more speaker protection thresholds are based on offline reliability testing of one or more audio speakers similar to the audio speaker and the controller generates one or more modeled parameters for the audio speaker and modifies the one or more speaker protection thresholds based on the one or more modeled parameters.

In accordance with these and other embodiments of the present disclosure, a method may include receiving one or more signals indicative of one or more operating characteristics of an audio speaker. The method may also include processing an audio input signal to generate an audio output signal communicated from the controller to the audio speaker based on a comparison of the one or more operating characteristics to one or more speaker protection thresholds, wherein the one or more speaker protection thresholds are based on offline reliability testing of one or more audio speakers similar to the audio speaker. The method may additionally include generating one or more modeled parameters for the audio speaker. The method may further include modifying the one or more speaker protection thresholds based on the one or more modeled parameters.

In accordance with these and other embodiments of the present disclosure, a system may include a controller configured to be coupled to an audio speaker, wherein the controller receives an audio input signal, and based on a displacement transfer function associated with the audio speaker, processes the audio input signal to generate an output audio signal communicated to the audio speaker, wherein the displacement transfer function correlates an amplitude and a frequency of the audio input signal to an expected displacement of the audio speaker in response to the amplitude and the frequency of the audio input signal.

In accordance with these and other embodiments of the present disclosure, a method may include receiving an audio input signal. The method may further include processing the audio input signal to generate an output audio signal communicated to an audio speaker based on a displacement transfer function associated with the audio speaker, wherein the displacement transfer function correlates an amplitude and a frequency of the audio input signal to an expected displacement of the audio speaker in response to the amplitude and the frequency of the audio input signal.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are explanatory examples and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
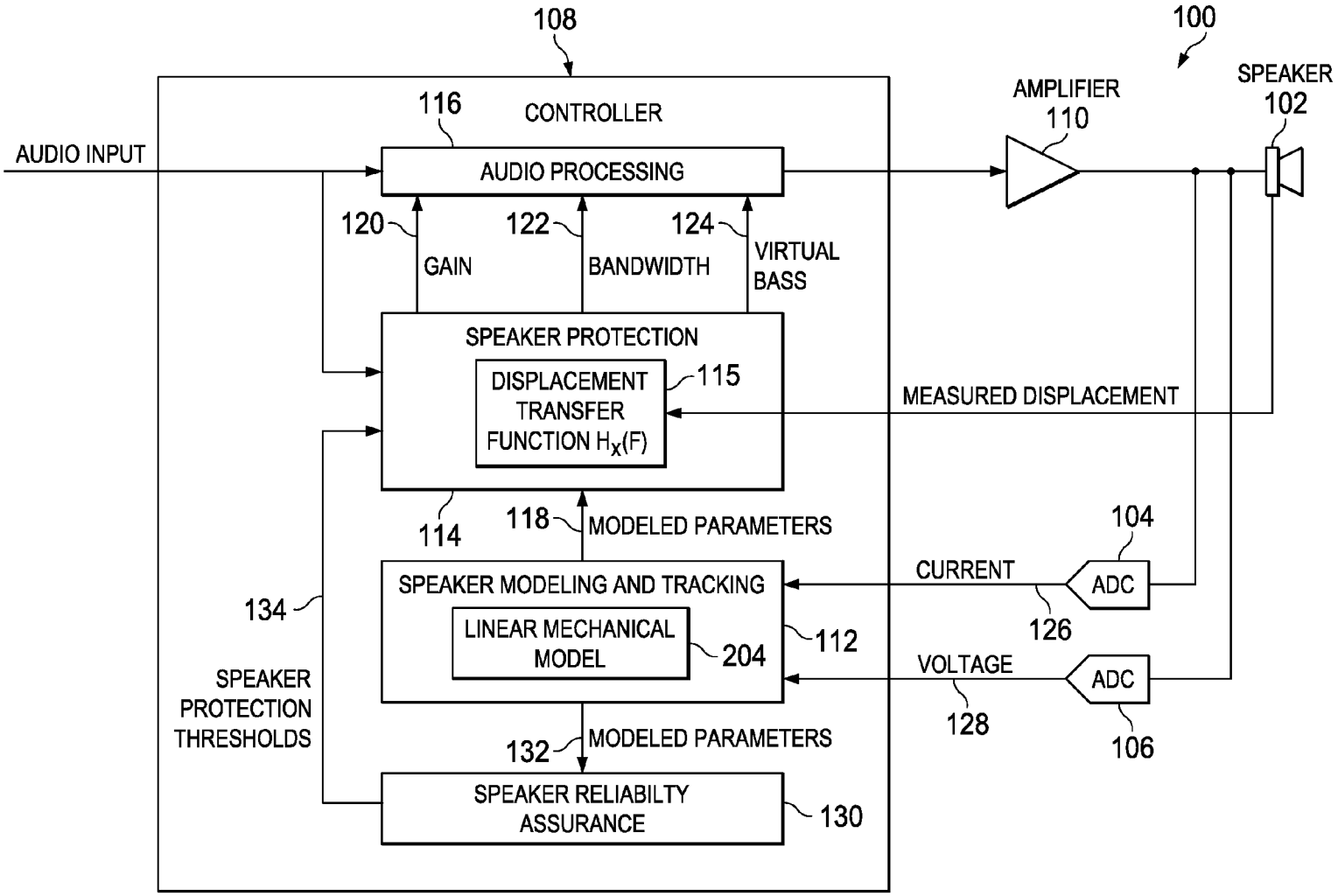
FIG. 1 illustrates a block diagram of an example system that uses speaker modeling and tracking to control operation of an audio speaker, in accordance with embodiments of the present disclosure.

FIG. 1 illustrates a block diagram of an example system 100 that employs a controller 108 to control the operation of an audio speaker 102, in accordance with embodiments of the present disclosure. Audio speaker 102 may comprise any suitable electroacoustic transducer that produces sound in response to an electrical audio signal input (e.g., a voltage or current signal). As shown in FIG. 1, controller 108 may generate such an electrical audio signal input, which may be further amplified by an amplifier 110. In some embodiments, one or more components of system 100 may be integral to a single integrated circuit (IC).

Controller 108 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 108 may interpret and/or execute program instructions and/or process data stored in a memory (not explicitly shown) communicatively coupled to controller 108. As shown in FIG. 1, controller 108 may be configured to perform speaker modeling and tracking 112, speaker protection 114, audio processing 116, and/or speaker reliability assurance 130, as described in greater detail below.

Amplifier 110 may be any system, device, or apparatus configured to amplify a signal received from controller 108 and communicate the amplified signal (e.g., to speaker 102). In some embodiments, amplifier 110 may comprise a digital amplifier configured to also convert a digital signal output from controller 108 into an analog signal to be communicated to speaker 102.

The audio signal communicated to speaker 102 may be sampled by each of an analog-to-digital converter 104 and an analog-to-digital converter 106, configured to respectively detect an analog current and an analog voltage associated with the audio signal, and convert such analog current and analog voltage measurements into digital signals 126 and 128 to be processed by controller 108. Based on digital current signal 126 and digital voltage signal 128, controller 108 may perform speaker modeling and tracking 112 in order to generate modeled parameters 118 (e.g., parameters indicative of a displacement associated with audio speaker 102 and/or a temperature associated with audio speaker 102) and modeled parameters 132 (e.g., parameters indicative of a force factor, a stiffness, damping factor, resonance frequency associated with audio speaker 102) for speaker 102, as described in greater detail below. In some embodiments, speaker modeling and tracking 112 may provide a recursive, adaptive system to generate such modeled parameters 118 and modeled parameters 132. In these and other embodiments, speaker modeling and tracking 112 may employ a linear mechanical model 204 modeling an ideal vibrational mechanical system, as is described in greater detail below. Example embodiments of speaker modeling and tracking 112 are discussed in greater detail below with reference to FIGS. 2 and 3.

Based on modeled parameters 132 (e.g., parameters indicative of a force factor, a stiffness, damping factor, resonance frequency associated with audio speaker 102) and/or offline reliability testing of audio speakers similar (e.g., of the same make and model) to audio speaker 102, controller 108 may perform speaker reliability assurance 130 to generate speaker protection thresholds 134, as described in greater detail below. Such speaker protection thresholds 134 may include, without limitation, an output power level threshold for audio speaker 102, a displacement threshold associated with audio speaker 102, and a temperature threshold associated with audio speaker 102. An example method for speaker reliability assurance 130 is discussed in greater detail below with reference to FIG. 4.

Controller 108 may perform speaker protection 114 based on one or more operating characteristics of the audio speaker, including without limitation modeled parameters 118 and/or the audio input signal, and application of speaker protection thresholds 134 to such one or more operating characteristics. For example, speaker protection 114 may compare modeled parameters 118 (e.g., a modeled displacement and/or modeled resistance of audio speaker 102) to corresponding speaker protection thresholds 134 (e.g., a displacement threshold and/or a temperature threshold), and based on such comparison, generate control signals for gain 120, bandwidth 122, and virtual bass 124 as described elsewhere in this disclosure. As another example, speaker protection 114 may apply displacement transfer function 115 to the audio input signal to predict a predicted displacement associated with audio speaker 102, and compare such predicted displacement to a corresponding speaker protection threshold 134 (e.g., a displacement threshold), and based on such comparison, generate control signals for gain 120, bandwidth 122, and virtual bass 124 as described elsewhere in this disclosure. Thus, by comparing a modeled displacement (as included within modeled parameters 118) or a predicted displacement (as predicted based on displacement transfer function 115) to an associated displacement threshold, speaker protection 114 may reduce gain 120 in order to reduce the intensity of the audio signal communicated to speaker 102 and/or control bandwidth 122 in order to filter out lower-frequency components of the audio signal which may reduce displacement of audio speaker 102, while causing virtual bass 124 to virtually add such filtered lower-frequency components to the audio signal. In addition or alternatively, by comparing a modeled resistance (as included within modeled parameters 118) to an associated temperature threshold, speaker protection 114 may reduce gain 120 in order to reduce the intensity of the audio signal communicated to speaker 102 and the heat generated by speaker 102.

In addition to performing speaker protection 114 based on comparison of one or more operating characteristics of speaker 102, speaker modeling and tracking 112 may ensure that speaker 102 operates under an output power level threshold for audio speaker 102. In some embodiments, such output power level threshold may be included within speaker protection thresholds 134.

As mentioned above, in some embodiments, speaker protection 114 may be performed by employing a displacement transfer function 115 that defines an expected speaker displacement as a function of a frequency of an audio signal communicated to audio speaker 102. In these embodiments, such displacement transfer function 115 may be based on offline testing and characterization and/or may be dynamically updated during operation of system 100 by actual measurement of displacement associated with and/or by modeling displacement in real time (e.g., such modeled displacement may be a part of modeled parameters 118 generated by speaker modeling and tracking 112).

Based on gain 120, bandwidth 122, and/or virtual bass 124, controller 108 may perform audio processing 116, whereby it applies the various control signals for gain 120, bandwidth 122, and/or virtual bass 124 to generate a processed audio signal which controller 108 communicates to amplifier 110.

Figure 2:
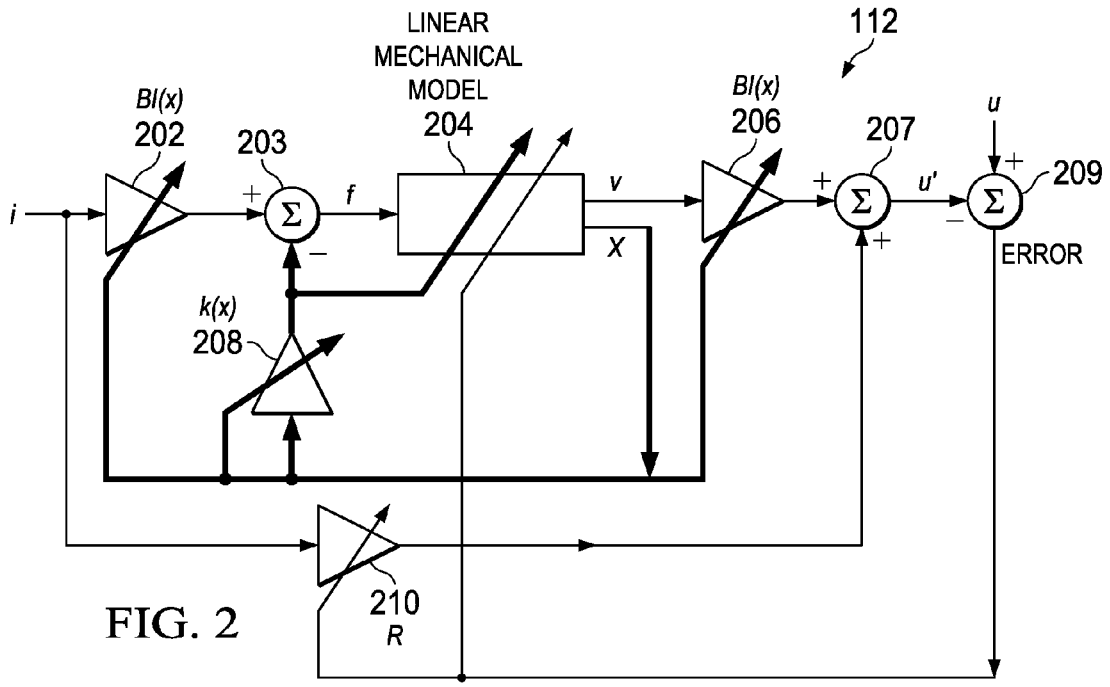
FIG. 2 illustrates a model for modeling and tracking characteristics of an audio speaker, in accordance with embodiments of the present disclosure.

FIG. 2 illustrates a more detailed block diagram of a system for performing modeling and tracking 112 shown in FIG. 1, in accordance with embodiments of the present disclosure. Speaker modeling and tracking 112 may be used to generate modeled parameters 118 and modeled parameters 132 based on an actual measured current and actual measured voltage (e.g., as indicated by digital current signal 126 and digital voltage signal 128, respectively). In some embodiments, speaker modeling and tracking 112 may provide a recursive, adaptive system to generate such modeled parameters 118 and modeled parameters 132. Central to speaker modeling and tracking 112 is a linear mechanical model 204, which may model displacement x and velocity v of audio speaker 102 in accordance with the equation for an ideal vibrational mechanical system:

$$f=m(d^2x/dt^2)+c(dx/dt)+kx$$

where $f$ is the force applied to a voice coil of audio speaker 102, m is the mass of the voice coil, c is the damping factor of the voice coil, k is the stiffness of the voice coil, and x is the displacement of the voice coil.

Values for v and x generated by linear mechanical model 204 may be used as inputs to other components of speaker modeling and tracking 112 and/or to affect coefficients of the various components of speaker modeling and tracking 112, as described in greater detail below. As shown in FIG. 2, the input to linear mechanical model 204 may be a modeled force $f$. The modeled force $f$ may be calculated by sum block 203 as the difference between: (i) the product of a force factor Bl(x) and a measured current i (e.g., calculated by block 202) and (ii) the product of a stiffness coefficient k(x) and the modeled displacement x. The measured current signal i may be a current sampled and converted by analog-to-digital converter 104.

In addition, a modeled voltage u' may be calculated by sum block 207 as the sum of: (i) the product of the force factor Bl(x) and the modeled velocity v (e.g., calculated by block 206) and (ii) the product of a measured current i and an electrical resistance R associated with the voice coil of audio speaker 102 (e.g., calculated by block 210). The value of error may in turn be calculated by sum block 209 as the difference between a measured voltage u and the modeled voltage u'. The measured voltage signal u may be a voltage sampled and converted by analog-to-digital converter 104.

Values for the error may be fed back into linear mechanical model 204 in order to modify one or more characteristics of linear mechanical model 204 (e.g., poles), as described in greater detail below. Values for the error may also be used to modify an modeled electrical resistance R as described in greater detail elsewhere in this disclosure. In addition, values for displacement x may be fed back to other components of speaker modeling and tracking 112, for example to update a force factor Bl(x) based on displacement (e.g., at blocks 202 and 206) or to update a stiffness k(x) based on displacement (e.g., at block 208). Furthermore, the values of the stiffness k(x) may be fed into linear mechanical model 204 in order to modify one or more characteristics of linear mechanical model 204 (e.g., poles), as described in greater detail below.

Accordingly, speaker modeling and tracking 112 provides a recursive, adaptive system which attempts to converge the modeled voltage u' to a measured voltage u. In some embodiments, speaker modeling and tracking 112 may be implemented as a discrete-time system algorithm, as described in greater detail below.

To further illustrate speaker modeling and tracking 112 performed by controller 108, consider an ideal vibrational mechanical system, which, as described above, may act in accordance with the following equation:

$$f(t)=m(d^2x/dt^2)+c(dx/dt)+kx(t)$$

where t is time. Notably, the above equation reflects that the ideal vibrational mechanical system is a second-order system.

Those of skill in the relevant art may appreciate that the LaPlace transform for the foregoing equation is:

$$f(s)=(ms^2+cs+k)x(s)$$

Those of skill in the relevant art may also appreciate that the following equation may be used to approximate a voltage u' across a speaker voice coil:

$$u'=Ri+Bl(x)v=Ri+Bl(x)(dx/dt)$$

where R is a resistance of the speaker voice coil, Bl(x) is the force factor of the voice coil as a function of displacement x, and v is the velocity of the voice coil. This equation is analogous to blocks 207, 206, and 210 of FIG. 2.

Those of skill in the relevant art may further appreciate that force $f$ on the voice coil may also be represented by the equation:

$$f(t)=Bl(x)i+[k(x)-k_0]x(t)$$

where $k_0$ is the stiffness k at a resting position. This equation is analogous to blocks 203, 202, and 208 of FIG. 2.

Also, under LaPlace transform theory:

$$x(s)/f(s)=1/(ms^2+cs+k);$$

and $$v(s)/f(s)=s/(ms^2+cs+k)$$

These equations represent the modeling performed by linear mechanical model 204. In accordance with these equations, x(s)/f(s) and v(s)/f(s) each have poles for values of s in which $ms^2+cs+k=0$. Using the quadratic equation, such poles $\lambda_1$ and $\lambda_2$ may be given by:

$$\lambda_1,\lambda_2=[-c\pm\sqrt{(c^2-4mk)}]/2m$$

Using impulse invariance theory, the equations for x(s)/f(s) and v(s)/f(s) may be rewritten in the z domain as:

$$x(z)/f(z)=C_xz^{-1}/(1+z_1z^{-1}+z_2z^{-2});$$

and $$v(z)/f(z)=C_v(1-z^{-2})/(1+z_1z^{-1}+z_2z^{-2})$$

where $z_1=-(e^{T\lambda_1}+e^{T\lambda_2})$, $z_2=e^{T\lambda_1}e^{T\lambda_2}=e^{T(\lambda_1+\lambda_2)}=e^{-Tc/m}$, e is the mathematical constant referred to as Euler's number or Napier's constant, T is the inverse of the sampling frequency of the system (e.g., the sampling rate of analog-to-digital converters 104 and 106), and $C_x$ and $C_v$ are matching coefficients related to displacement and velocity, respectively, that depend on an initial direct current state in order to match the z domain to the s domain. $z_1$ and $z_2$ are coefficients in the z transfer function of linear mechanical model 204. In the above equations, the value $z_2$ is a constant. From the above equations, because the stiffness k is a function of x, the various parameters $\lambda_1$, $\lambda_2$, $z_1$, $C_x$, and $C_v$ associated with linear mechanical model 204, which all depend at least in part on k, also vary with displacement x.

Converting various equations above into the discrete-time domain, a recursive, adaptive method may be performed by controller 108 in order to implement speaker modeling and tracking 112. In accordance with such method, controller 108 may receive a current signal i indicative of an electrical current associated with an audio speaker and a voltage signal v indicative of an electrical voltage associated with the audio speaker. Controller 108 may generate modeled characteristics (e.g., displacement x, resistance R) for audio speaker 102 in response to the current signal and the voltage signal. Based on such modeled characteristics, controller 108 may control an audio signal communicated to audio speaker 102 wherein the modeled characteristics are based on discrete-time domain information and displacement domain information. Controller 108 may also use the discrete-time domain information and the displacement domain information to update the modeled characteristics in an adaptive, recursive manner.

In some embodiments, the discrete-time domain information is derived from a second-order system (e.g., a discrete-time application of linear mechanical model 204) in which a least-mean squares recursion of the second-order system may be performed. In these and other embodiments, the displacement domain information may be derived from a third- or higher-order system. For example, displacement domain information may be derived from a third- or higher-order system modeling a force factor associated with the audio speaker. Additionally or alternatively, the displacement domain information is derived from a third- or higher-order system modeling a stiffness associated with the audio speaker.

Accordingly, such recursive, adaptive method incorporates both small signal (e.g., linear) and large signal (e.g., nonlinear) behaviors of audio speaker 102. An example of such a method is discussed in detail in reference to FIG. 3, below.

Figure 3:
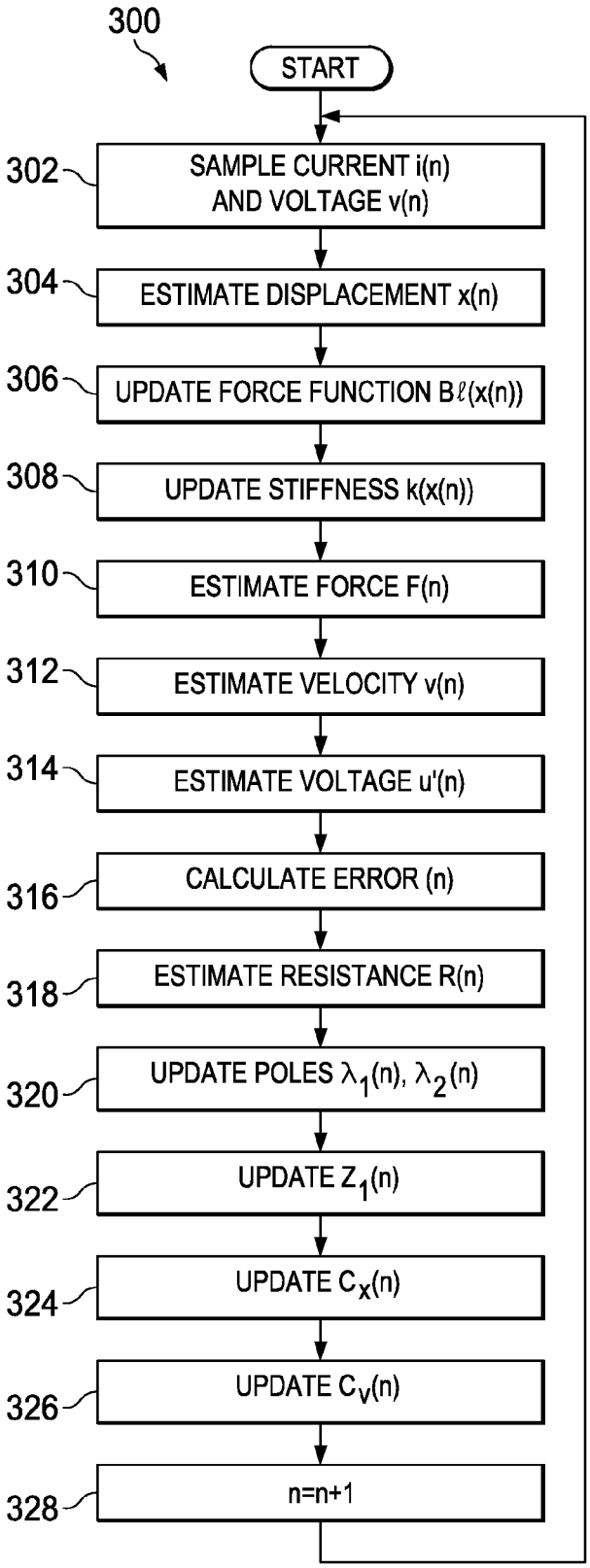
FIG. 3 illustrates a flow chart of an example method for speaker modeling and tracking, in accordance with embodiments of the present disclosure.

FIG. 3 illustrates a flow chart of such an example method 300 for speaker modeling and tracking 112, in accordance with embodiments of the present disclosure. According to one embodiment, method 300 begins at step 302. Teachings of the present disclosure are implemented in a variety of configurations of system 100. As such, the preferred initialization point for method 300 and the order of the steps comprising method 300 may depend on the implementation chosen.

At step 302, controller 108 may sample a digital current signal i(n) (e.g., current signal 126) and a digital voltage signal v(n) (e.g., voltage signal 128), representing a current through a voice coil of audio speaker 102 and a voltage across the voice coil, respectively. Such discrete-time current signal and voltage signal may be converted from an analog current sampled by analog-to-digital converter 104 and an analog voltage sampled by analog-to-digital converter 106, respectively.

At step 304, controller 108 may model a displacement x(n). From the z-domain equation for x(z)/f(z), above, such displacement x(n) may be written in the discrete-time domain as:

$$x(n)=C_x(n-1)f(n-1)-z_2x(n-2)$$

This equation is analogous to linear mechanical model 204 depicted in FIG. 2.

At step 306, controller 108 may update a force factor Bl(x(n)). As mentioned above, in some embodiments, displacement domain information may be derived from a third- or higher-order system. For example, in a fourth-order system, the force factor may be defined by the equation:

$$Bl(n)=Bl_0+Bl_1x(n)+Bl_2x^2(n)+Bl_3x^3(n)+Bl_4x^4(n)$$

where the coefficients $Bl_0$, $Bl_1$, $Bl_2$, $Bl_3$, and/or $Bl_4$ may be based on pre-manufacturing characterization of audio speaker 102 and/or similar audio speakers (e.g., based on testing equipment manufactured by Klippel GmbH). Accordingly, nonlinear effects of displacement on the force factor may be modeled.

At step 308, controller 108 may update a stiffness function k(x(n)). Again, as mentioned above, in some embodiments, displacement domain information may be derived from a third- or higher-order system. For example, in a fourth-order system, the stiffness may be defined by the equation:

$$k(n)=k_0+k_1x(n)+k_2x^2(n)+k_3x^3(n)+k_4x^4(n)$$

where the coefficients $k_0$, $k_1$, $k_2$, $k_3$, and/or $k_4$ may be based on pre-manufacturing characterization of audio speaker 102 and/or similar audio speakers (e.g., based on testing equipment manufactured by Klippel GmbH). Accordingly, nonlinear effects of displacement on the stiffness may be modeled.

At step 310, controller 108 may model a force f(n) upon the voice coil. From the equation for force f(x), above, such displacement f(n) may be written in the discrete-time domain as:

$$f(n)=Bl(n)i(n)+[k(n)-k_0]x(n)$$

This equation is analogous to blocks 203, 202, and 208 depicted in FIG. 2.

At step 312, controller 108 may model a velocity v(n) of the voice coil. From the z-domain equation for v(z)/f(z), above, such velocity v(n) may be written in the discrete-time domain as:

$$v(n)=C_v(n-1)f(n)-C_v(n-1)f(n-2)-z_1(n-1)v(n-1)-z_2v(n-2)$$

This equation is analogous to linear mechanical model 204 depicted in FIG. 2.

At step 314, controller 108 may model an expected voltage u'(n) across the voice coil. From the equation above for voltage u, above, such voltage u'(n) may be written in the discrete-time domain as:

$$u'(n)=R(n-1)i(n)+Bl(n)v(n)$$

This equation is analogous to blocks 207, 206, and 210 depicted in FIG. 2.

At step 316, based on such expected voltage u'(n) and an actual measured voltage u(n), controller 108 may calculate an error(n) as:

$$\text{error}(n)=u(n)-u'(n)$$

Notably, this equation is analogous to block 209 depicted in FIG. 2.

At step 318, controller 108 may model a resistance R(n). From above, error(n)=u(n)−u'(n)=u(n)−R(n−1)i(n)−Bl(n)v(n). Accordingly, derror(n)/dR=−i(n). Hence:

$$R(n)=R(n-1)-\mu_R\cdot\text{error}(n)\cdot\text{derror}(n)/dR=R(n-1)+\mu_R\cdot\text{error}(n)\cdot i(n)$$

Where $\mu_R$ is a step size for updating R(n).

At step 320, controller 108 may update poles $\lambda_1$ and $\lambda_2$ of the linear mechanical model 204 in accordance with the quadratic equation:

$$\lambda_1(n),\lambda_2(n)=[-c\pm\sqrt{(c^2-4mk(n))}]/2m$$

At step 322, controller 108 may update z transfer function coefficient $z_1(n)$. From the equation above for $z_1$, $z_1(n)$ may be written in the discrete-time domain as:

$$z_1(n)=-(e^{T\lambda_1(n)}+e^{T\lambda_2(n)})$$

At step 324, controller 108 may update displacement matching coefficient $C_x(n)$. By substitution in various equations set forth above, $C_x(n)$ may be written in the discrete-time domain as:

$$C_x(n)=(1+z_1(n)+z_2)/k(n)$$

At step 326, controller 108 may update velocity matching coefficient $C_v(n)$. By substitution in various equations set forth above, it may be seen that:

$$dv(n)/dCv=f(n)-f(n-2)-z_1(n-1)\cdot dv(n-1)/dC_v-z_2\cdot dv(n-2)/dC_v$$

With further substitution, controller 108 may update $C_v(n)$ as:

$$C_v(n)=C_v(n-1)+\mu_{C_v}\cdot Bl(n)\cdot \text{error}(n)\cdot dv(n)/dC_v$$

Where $\mu_{C_v}$ is a step size for updating $C_v(n)$.

At step 328, time n may step to its next interval. After step 328, method 300 may return again to step 302, and steps 302 to 328 may be recursively repeated.

Although FIG. 3 discloses a particular number of steps to be taken with respect to method 300, method 300 may be executed with greater or fewer steps than those depicted in FIG. 3. In addition, although FIG. 3 discloses a certain order of steps to be taken with respect to method 300, the steps comprising method 300 may be completed in any suitable order.

Method 300 may be implemented using controller 108 or any other system operable to implement method 300. In certain embodiments, method 300 may be implemented partially or fully in software and/or firmware embodied in computer-readable media.

Figure 4:
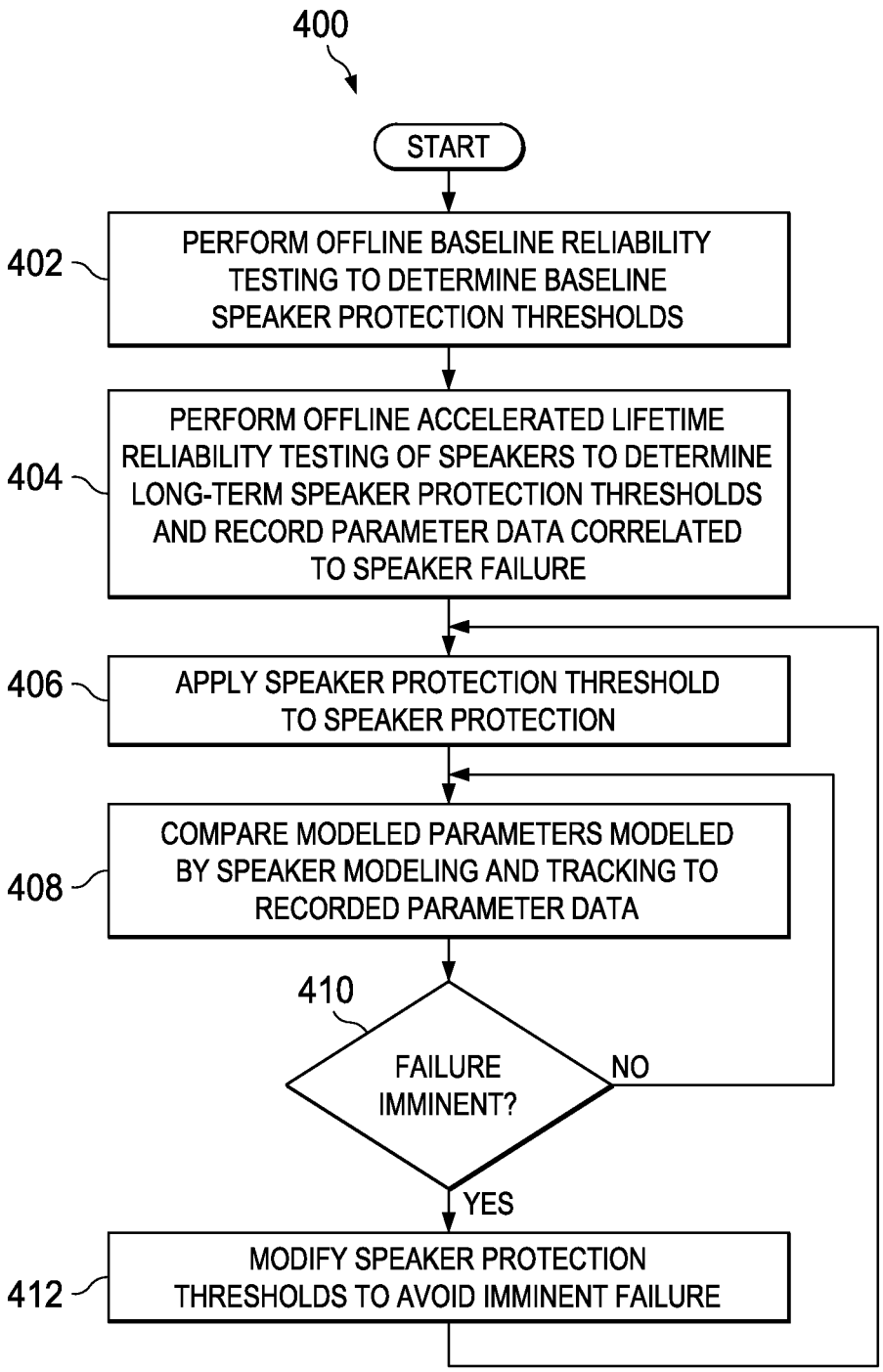
FIG. 4 illustrates a flow chart of such an example method for speaker reliability and assurance, in accordance with embodiments of the present disclosure.

FIG. 4 illustrates a flow chart of such an example method 400 for performing speaker reliability and assurance 130 depicted in FIG. 1, in accordance with embodiments of the present disclosure. According to one embodiment, method 400 begins at step 402. Teachings of the present disclosure are implemented in a variety of configurations of system 100. As such, the preferred initialization point for method 400 and the order of the steps comprising method 400 may depend on the implementation chosen. In some embodiments of the present disclosure, steps 402 and 404 may be performed "offline" prior to manufacture or the actual intended end use of system 100, while steps 406 through 412 may be performed during operation of system 100 during its actual intended end use.

At step 402, a plurality of speakers similar or identical to speaker 102 (e.g., speakers of the same model number) may be subject to offline baseline reliability testing. During offline baseline reliability testing, such speakers may be tested (e.g., using any suitable test and/or analysis equipment) to determine a maximum power level for which such speakers meet a set of short-term reliability criteria, including satisfactory audio quality criteria (e.g., little or no signal clipping and little or no signal distortion) and operation for such short term (e.g., 10 minutes) with no damage caused by overheating or over-excursion. Based on this offline baseline reliability testing, the maximum power level and a measured maximum displacement and temperature (i.e., resistance) associated with the maximum power level may be established as baseline speaker protection thresholds. During such testing, speaker protection similar to that provided by speaker protection 114 may be applied to control the various speakers under test.

At step 404, a plurality of speakers similar or identical to speaker 102 (e.g., speakers of the same model number) may be subject to offline accelerated lifetime reliability testing, using the baseline speaker protection thresholds as a starting point for determining long-term speaker protection thresholds. During offline accelerated lifetime reliability testing, the plurality of speakers will be tested to simulate the stress such speakers may experience during a lifetime of such speaker in its actual intended end use. For example, testing some model speakers continuously for 96 hours may allow for adequate determination of the range of operation for which a speaker will remain failure-free throughout its desired lifetime in actual intended end use. During such testing, speaker protection similar to that provided by speaker protection 114 may be applied to control the various speakers under test. Based on such offline accelerated lifetime reliability testing, a long-term power level threshold and other long-term speaker protection thresholds (e.g., displacement and temperature/resistance) resulting in desired long-term reliability criteria (e.g., lifespan, failure rates, etc.) may be established.

Also during the offline accelerated lifetime reliability testing performed at step 404, data regarding other parameters associated with the speakers under test (e.g., resonance frequency, stiffness, damping factor, force factor, etc.) may be measured and analyzed to determine values or other characteristics of such parameters that can be correlated to failures of speakers under test. Such parameter data, along with the long-term speaker protection thresholds, may be stored in a memory or other computer-readable media accessible by controller 108, such that such speaker protection thresholds and parameter data may be applied by controller 108 to perform speaker reliability assurance during operation of system 100.

At step 406, speaker protection thresholds (either as determined during offline reliability testing in step 404 or as modified in step 412 as described below) may be applied to speaker protection 114, and controller 108 may perform speaker protection 114 based on such speaker protection thresholds as described elsewhere in this disclosure.

At step 408, controller 108 may compare modeled parameters 132 (e.g., force factor Bl(x(n)), stiffness k(x(n)), damping factor c, displacement values x(n) indicating a resonance frequency of speaker 102, etc.) to the recorded parameter data obtained during offline reliability testing. At step 410, based on such comparison, controller 108 may determine if any of the modeled parameters 132 indicate that a failure is imminent. Controller 108 may determine a failure is imminent if any of the modeled parameters 132 are of or near a value that correlates to a failure of speaker 102, as indicated by the recorded parameter data. If controller 108 determines that a failure is imminent, method 400 may proceed to step 412. Otherwise, if a failure is not imminent, method 400 will proceed again to step 406, and steps 408 and 410 may repeat until such time as controller 108 determines a failure is imminent.

At step 412, in response to a determination that a failure is imminent, controller 412 may modify the speaker protection thresholds (e.g., decrease the output power threshold, decrease the displacement threshold, or decrease the temperature threshold). After completion of step 412, method 400 may proceed again to step 406. The steps 406 through 412 may repeat during the lifetime of speaker 101 and or system 100.

Although FIG. 4 discloses a particular number of steps to be taken with respect to method 400, method 400 may be executed with greater or fewer steps than those depicted in FIG. 4. In addition, although FIG. 4 discloses a certain order of steps to be taken with respect to method 400, the steps comprising method 400 may be completed in any suitable order.

Method 400 may be implemented using controller 108 or any other system operable to implement method 400. In certain embodiments, method 400 may be implemented partially or fully in software and/or firmware embodied in computer-readable media.

As discussed above, controller 108 may perform speaker protection 114 depicted in FIG. 1, in which numerous control signals for processing an audio signal (e.g., gain 120, bandwidth 122, and/or virtual bass 124), may be generated based on modeled parameters 118, speaker protection thresholds 134, and/or an audio input signal to be processed by controller 108. To perform speaker protection 114 based on an audio input signal, controller 108 may employ a displacement transfer function represented by the equation:

$$H_x(f)=x(f)/V_{in}(f)$$

Where $H_x(f)$ is the transfer function as a function of frequency $f$ of the audio input signal which may be expressed in a unit length divided by a unit voltage (e.g., millimeters per volt), $x(f)$ is a speaker displacement as a function of frequency $f$, and $V_{in}(f)$ is a voltage of the audio input signal as a function of frequency $f$.

Figure 5:
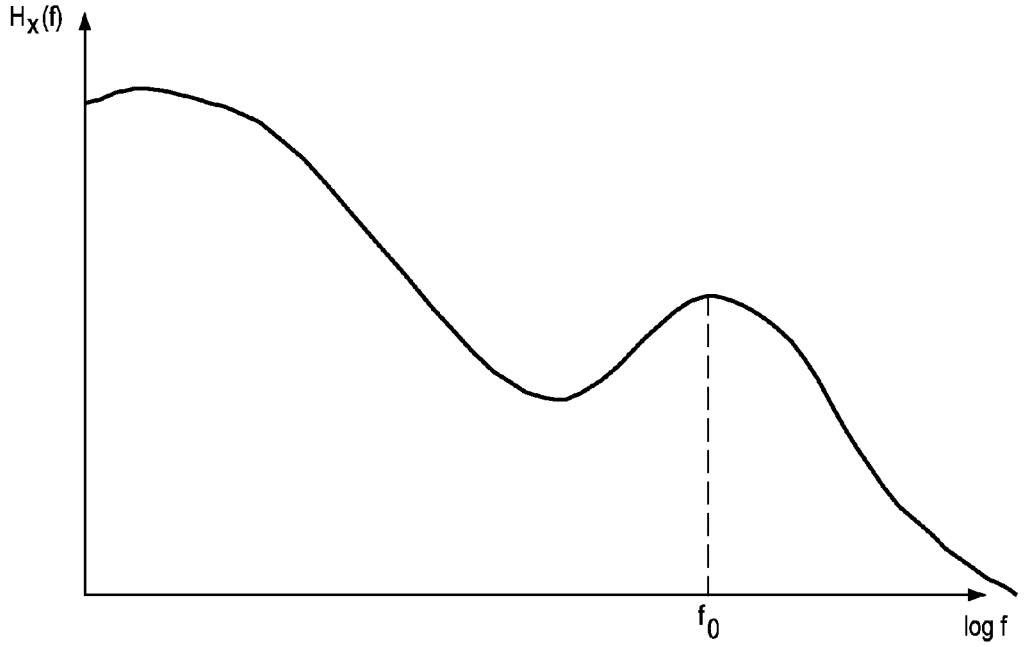
FIG. 5 illustrates a mathematical graph of an example transfer function for an audio speaker, in accordance with embodiments of the present disclosure.

FIG. 5 illustrates a mathematical graph of an example displacement transfer function 115 for an audio speaker 102, in accordance with embodiments of the present disclosure, depicting the displacement transfer function $H_x(f)$ on the vertical axis versus the logarithm of the frequency $f$ on the horizontal axis. As shown in FIG. 5, displacement associated with a typical audio speaker 102 may decrease as frequency increases from zero, but may increase as frequency $f$ approaches a resonance frequency $f_0$, before again decreasing from the resonance frequency to infinity.

Displacement transfer function 115 for an audio speaker 102 may be obtained via offline testing and characterization of one or more speakers similar or identical to (e.g., of same make and model) audio speaker 102, for example by performing a frequency sweeping test to a speaker and observing the results. Displacement transfer function 115 may be obtained dynamically based on actual performance of audio speaker 102 in system 100. For example, controller 108 may dynamically obtain displacement transfer function 115 by directly measuring displacement x(t) of audio speaker 102 in real time (e.g., using a laser or other sensor) and comparing such displacement with the audio input signal generating such displacement. As another example, controller 108 may obtain displacement transfer function 115 by modeling displacement x(t) in real time (e.g., such a modeled displacement may be included among modeled parameters 118 generated by speaker modeling and tracking 112).

To illustrate determining displacement transfer function 115 by measuring displacement x(t) or modeling displacement x(t) in real time based on modeled parameters 118, assume an audio input signal wav(t) in the time-domain with a frequency domain function wav($f$) which is the fast Fourier transform of wav($f$). Thus, wav($f$)=FFT(wav(t)). Substituting wav($f$) for $v_{IN}(f)$ in the above equation for displacement transfer function $H_x(f)$ gives:

$$x(f)=H_x(f)\cdot \mathrm{wav}(f)$$

Because x($f$)=FFT(x(t)):

$$FFT(x(t))=H_x(f)\cdot \mathrm{wav}(f)$$

Thus, if x(t) can be dynamically measured or modeled:

$$H_x(f)=FFT(x(t))/\mathrm{wav}(f)$$

Accordingly, displacement transfer function 115 may be updated in real time and may remain accurate and reliable over time and under different operating conditions (e.g., temperature, humidity, etc.).

With displacement transfer function 115 available, whether statically and/or dynamically generated, it may be used by controller 108 to perform "look-forward" displacement prediction and over-excursion protection. Because:

$$\begin{aligned} x(t) &= IFFT(x(f)) \\ &= IFFT(H_x(f)\cdot wav(f)) \\ &= IFFT(H_x(f)\cdot FFT(wav(t))) \end{aligned}$$

and wav(t) is the audio input signal processed by controller 108, a predicted displacement x(t) of audio speaker 102 may be made. Thus, if the predicted displacement x(t) is greater than a displacement threshold (e.g., as indicated by speaker protection thresholds 134), controller 108 may protect speaker 102 by applying a suitable control value (e.g., a reduced gain 120), such that audio processing 116 may modify the input audio signal if the overexcursion does not occur.

In addition, speaker protection 114 may control bandwidth 122 and/or virtual bass 124 based on displacement transfer function 115 and an audio input signal wav(t). For example, because the frequency response of a typical speaker causes higher displacements at low frequencies and at frequencies near the resonant frequency $f_0$, speaker protection 114 of controller 108 may generate bandwidth control signals 122 such that audio processing 116 effectively creates a high-pass filter for the audio input signal attenuating signals below a particular cutoff frequency and effectively creates a notch filter attenuating signals within a certain range of the resonant frequency $f_0$. Thus, by determining which ranges of frequencies result in expected displacements over a displacement threshold, speaker protection 114 may control bandwidth control signal 122 to attenuate signals in such frequency ranges. Furthermore, in embodiments in which displacement transfer function 115 is dynamically updated on measured or modeled displacement, speaker protection 114 may in turn dynamically modify bandwidth control signal 122 over time, further increasing accuracy and reliability.

Speaker protection 114 may also employ virtual bass enhancement aimed at adding signal in the audio processing of the audio input signal in order to compensate for the volume and bass loss due to the high-pass filtering described above. To perform virtual bass enhancement, speaker protection 114 may, for components of the audio input signal filtered by the high-pass filter, generate a virtual bass control signal 124 such that audio processing 116 generates corresponding signals at harmonic frequencies of the attenuated low-frequency signal components, such that the harmonic frequency signals cause the attenuated low-frequency signal components to be psychoacoustically perceived by a listener of speaker 102. To ensure that such harmonic frequencies of the attenuated low-frequency signal components do not occur in the regions of the frequency spectrum where a risk of overexcursion exists, speaker protection 114 may generate control signals (e.g., bandwidth control signal 122 and virtual bass signal 124), such that a bandpass filter is applied to the bass enhancement signal, the bandpass filter applied to certain regions of the displacement transfer function where displacement is small (e.g., frequencies greater than the cutoff frequency of the high-pass filter but lesser than the frequencies attenuated by the notch filter).

In addition, controller 108 may, from time to time based on modeled parameters 118, including modeled parameters for resistance R(n), displacement x(n), and/or other parameters, control gain 120, bandwidth 122, virtual bass 124, and/or other components associated with an audio signal to be communicated to audio speaker 102, modify or distort an audio input signal to generate an audio output signal to be communicated to audio speaker 102. Thus, based on speaker protection thresholds 134, modeled parameters 118, and/or an audio input signal, controller 108 may apply speaker protection 114 to generate control signals for gain 120, bandwidth 122, and/or virtual bass 124 to cause audio processing 116 to modify or distort an audio input signal in order to prevent audio speaker 102 from experiencing overexcursion, overheating, and/or other undesirable effects.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A system comprising:

a controller configured to be coupled to an audio speaker, wherein the controller receives one or more signals indicative of one or more operating characteristics of the audio speaker and compares the one or more operating characteristics to one or more speaker protection thresholds, and based on the comparison, processes an audio input signal to generate an audio output signal communicated from the controller to the audio speaker, and the controller generates one or more modeled parameters for the audio speaker and modifies the one or more speaker protection thresholds based on the one or more modeled parameters;

wherein:

the controller generates the one or more modeled parameters by receiving a current signal indicative of an electrical current associated with the audio speaker and a voltage signal indicative of an electrical voltage associated with the audio speaker, and in response to the current signal and the voltage signal, generates the one or more modeled parameters for the audio speaker; and the one or more modeled parameters are based on discrete-time domain information and displacement domain information and the discrete-time domain information and the displacement domain information are used to update the one or more modeled parameters.

2. The system of claim 1, wherein the one or more modeled parameters comprise one or more of a force factor associated with the audio speaker, a stiffness associated with the audio speaker, a damping factor associated with the audio speaker, and a resonance frequency of the audio speaker.

3. The system of claim 1, wherein one or more operating characteristics comprise one or more of a displacement associated with the audio speaker and a temperature associated with the audio speaker.

4. The system of claim 1, wherein the one or more operating characteristics comprise a predicted displacement associated with the audio speaker and wherein the controller determines the predicted displacement based on the audio input signal.

5. The system of claim 1, wherein the one or more operating characteristics comprise one or more of a modeled displacement associated with the audio speaker and a modeled temperature associated with the audio speaker, and wherein the controller models the one or more operating characteristics by receiving a current signal indicative of an electrical current associated with the audio speaker and a voltage signal indicative of an electrical voltage associated with the audio speaker, and in response to the current signal and the voltage signal, generates the one or more modeled parameters for the audio speaker.

6. The system of claim 1, wherein the one or more speaker thresholds comprise at least one of an output power level threshold associated with the audio speaker, a displacement threshold associated with the audio speaker, and a temperature threshold associated with the audio speaker.

7. The system of claim 1, wherein the controller modifies the one or more speaker protection thresholds based on a determination that the one or more modeled parameters indicate that a failure of the audio speaker is imminent.

8. The system of claim 7, wherein the controller reduces a maximum output power level associated with the speaker responsive to the determination that the one or more modeled parameters indicate that a failure of the audio speaker is imminent.

9. A method comprising:

receiving one or more signals indicative of one or more operating characteristics of an audio speaker;

processing an audio input signal to generate an audio output signal communicated from a controller to the audio speaker based on a comparison of the one or more operating characteristics to one or more speaker protection thresholds;

generating one or more modeled parameters for the audio speaker; and modifying the one or more speaker protection thresholds based on the one or more modeled parameters;

wherein:

generating the one or more modeled parameters comprises:

receiving a current signal indicative of an electrical current associated with the audio speaker and a voltage signal indicative of an electrical voltage associated with the audio speaker; and in response to the current signal and the voltage signal, generating the one or more modeled parameters for the audio speaker; and the one or more modeled parameters are based on discrete-time domain information and displacement domain information and the discrete-time domain information and the displacement domain information are used to update the one or more modeled parameters.

10. The method of claim 9, wherein the one or more modeled parameters comprise one or more of a force factor associated with the audio speaker, a stiffness associated with the audio speaker, a damping factor associated with the audio speaker, and a resonance frequency of the audio speaker.

11. The method of claim 9, wherein one or more operating characteristics comprise one or more of a displacement associated with the audio speaker and a temperature associated with the audio speaker.

12. The method of claim 9, wherein the one or more operating characteristics comprise a predicted displacement associated with the audio speaker and wherein the controller determines the predicted displacement based on the audio input signal.

13. The method of claim 9, wherein the one or more operating characteristics comprise one or more of a modeled displacement associated with the audio speaker and a modeled temperature associated with the audio speaker, and wherein generating the one or more operating characteristics comprises:

receiving a current signal indicative of an electrical current associated with the audio speaker and a voltage signal indicative of an electrical voltage associated with the audio speaker; and in response to the current signal and the voltage signal, generating the one or more modeled parameters for the audio speaker.

14. The method of claim 9, wherein the one or more speaker thresholds comprise at least one of an output power level threshold associated with the audio speaker, a displacement threshold associated with the audio speaker, and a temperature threshold associated with the audio speaker.

15. The method of claim 9, further comprising modifying the one or more speaker protection thresholds based on a determination that the one or more modeled parameters indicate that a failure of the audio speaker is imminent.

16. The method of claim 15, further comprising reducing a maximum output power level associated with the speaker responsive to the determination that the one or more modeled parameters indicate that a failure of the audio speaker is imminent.

* * * * *